US009943212B2

(12) United States Patent
Kang

(10) Patent No.: US 9,943,212 B2
(45) Date of Patent: Apr. 17, 2018

(54) DUST SUCTION DEVICE

(71) Applicant: TESTONIC CO., LTD., Siheung-si, Gyeonggi-do (KR)

(72) Inventor: Ok Nam Kang, Ansan-si (KR)

(73) Assignee: TESTONIC CO., LTD., Siheung-si, Gyeonggi-Do (KR)

( * ) Notice: Subject to any disclaimer, the term of this patent is extended or adjusted under 35 U.S.C. 154(b) by 744 days.

(21) Appl. No.: 14/378,695

(22) PCT Filed: Oct. 4, 2012

(86) PCT No.: PCT/KR2012/008009
§ 371 (c)(1),
(2) Date: Oct. 4, 2015

(87) PCT Pub. No.: WO2013/122300
PCT Pub. Date: Aug. 22, 2013

(65) Prior Publication Data
US 2016/0015244 A1 Jan. 21, 2016

(30) Foreign Application Priority Data
Feb. 15, 2012 (KR) ..... 10-2012-0015200

(51) Int. Cl.
*A47L 23/22* (2006.01)
*A47L 7/00* (2006.01)
*A47L 9/28* (2006.01)

(52) U.S. Cl.
CPC ..... *A47L 23/22* (2013.01); *A47L 7/0047* (2013.01); *A47L 9/2821* (2013.01); *A47L 9/2842* (2013.01)

(58) Field of Classification Search
CPC .... A47L 9/2821; A47L 9/2842; A47L 7/0047; A47L 23/22; A47L 5/28; A47L 9/1683; A47L 9/127
See application file for complete search history.

(56) References Cited

U.S. PATENT DOCUMENTS 3,064,298 A * 11/1962 Jones ..... A47L 23/263 15/310
7,725,974 B2 * 6/2010 Hughes ..... A47L 23/02 15/104.92
8,092,564 B2 * 1/2012 Totsugi ..... A47L 9/281 15/301

FOREIGN PATENT DOCUMENTS

KR 10-2004-0055134 A 6/2004
KR 10-2009-0010029 A 1/2009
KR 10-2011-0021041 A 3/2011
KR 10-2011-0119441 A 11/2011
KR 10-1098103 B1 12/2011

OTHER PUBLICATIONS

International Search Report for International Application No. PCT/KR2012/008009.

* cited by examiner

*Primary Examiner* — Robert Scruggs
(74) *Attorney, Agent, or Firm* — LRK Patent Law Firm

(57) ABSTRACT

A dust suction device includes: a housing having a plurality of inlets for the inflow of impurities formed thereon and an inner region of which is independently divided; and resilient actuating members, provided inside the inlets, for opening or closing the inlets by pressure applied from the outside.

9 Claims, 6 Drawing Sheets

[Fig. 1]
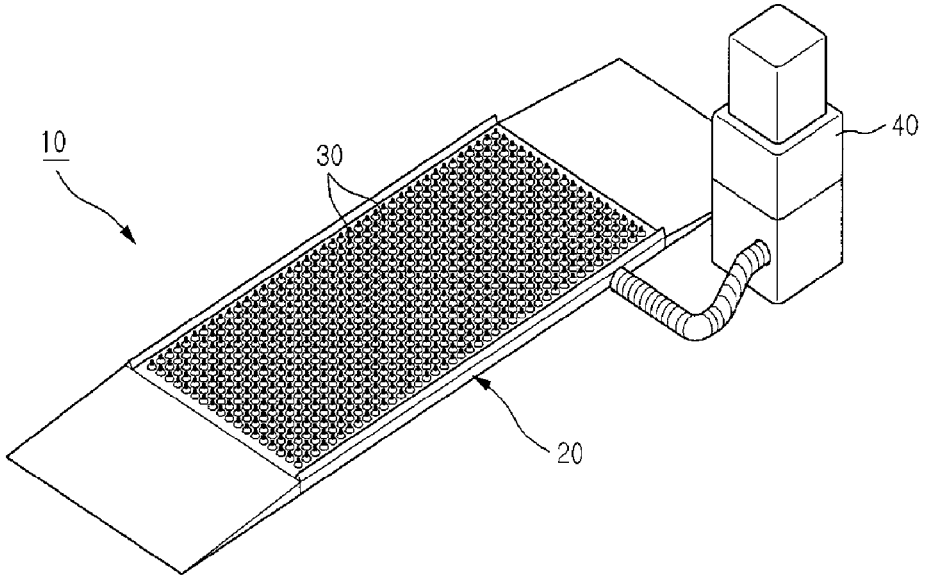
[Fig. 2]
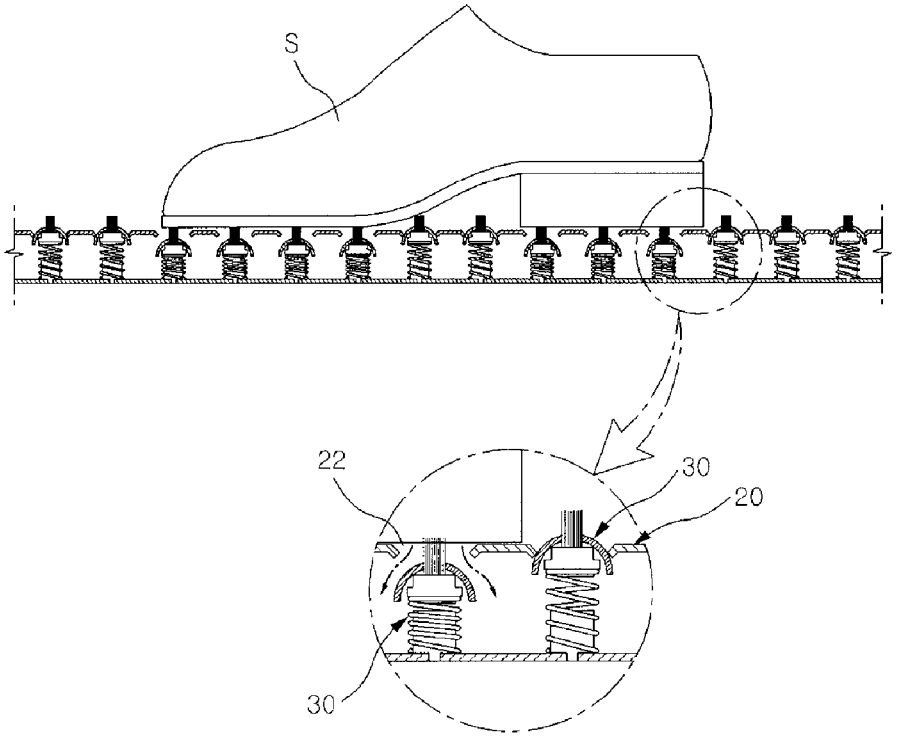

[Fig. 3]
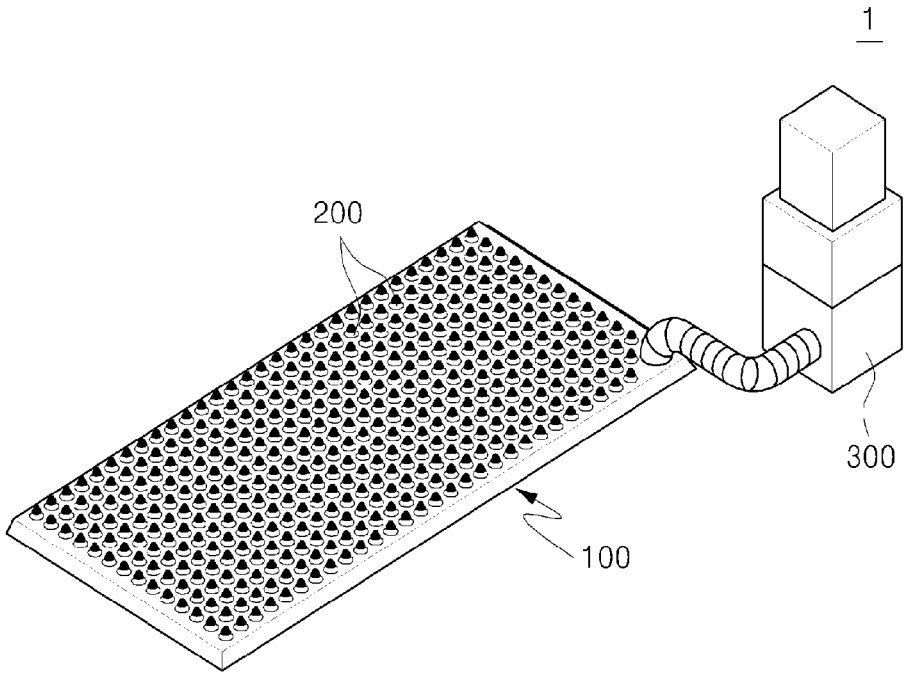
[Fig. 4]
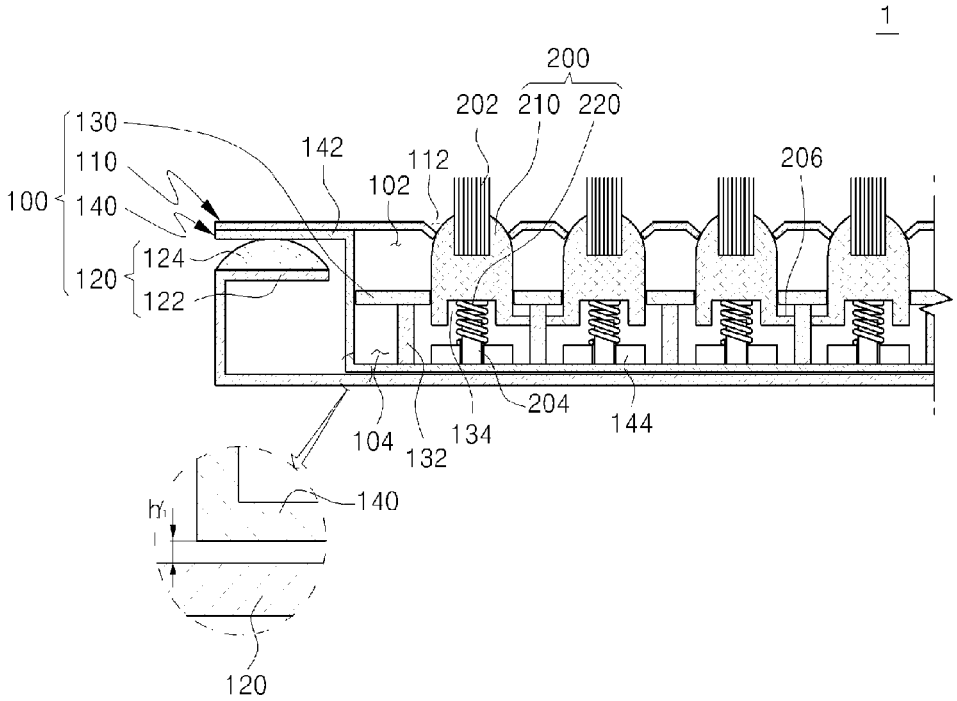

[Fig. 5]
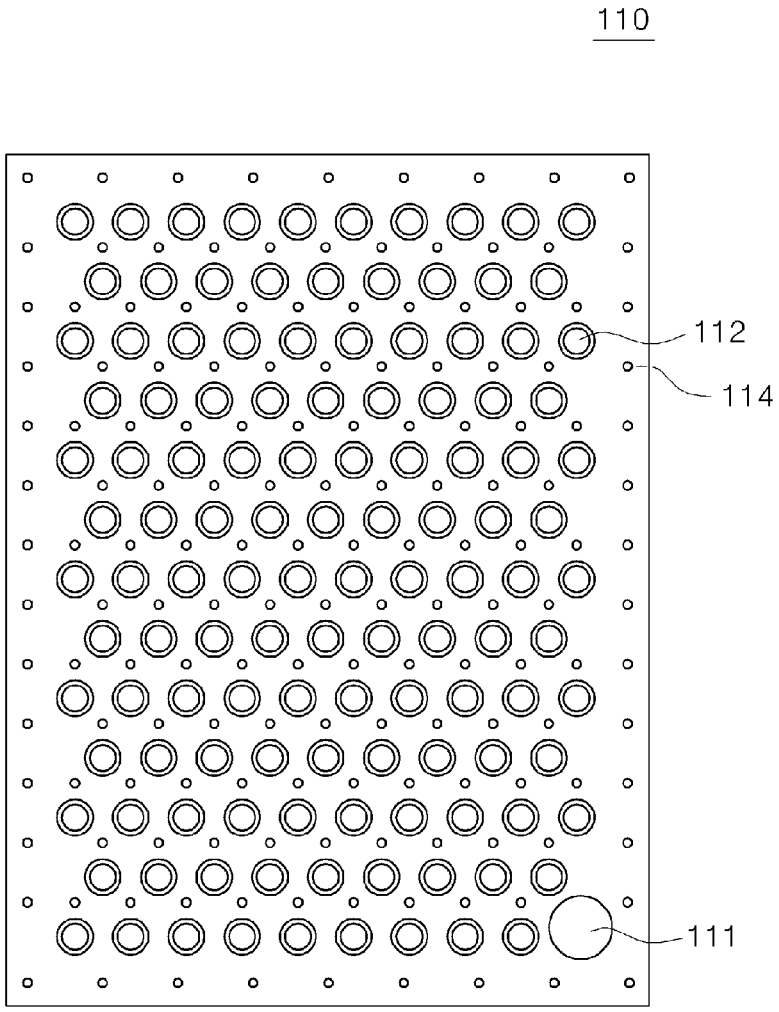
[Fig. 6]
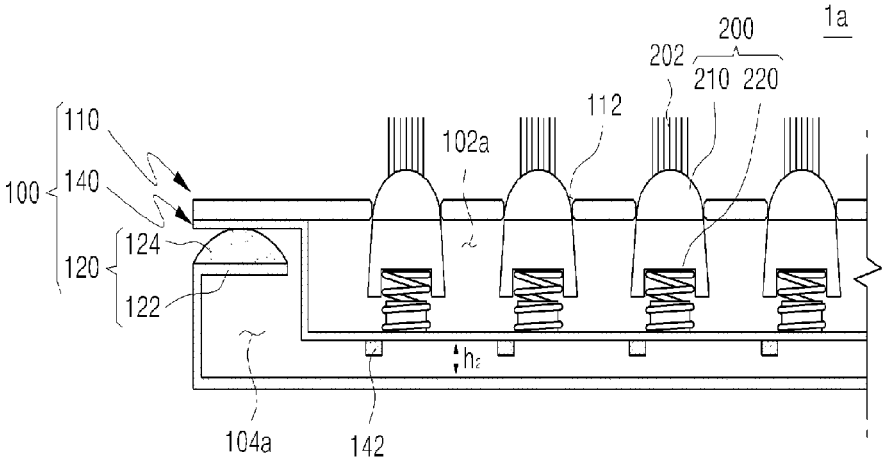

[Fig. 7]
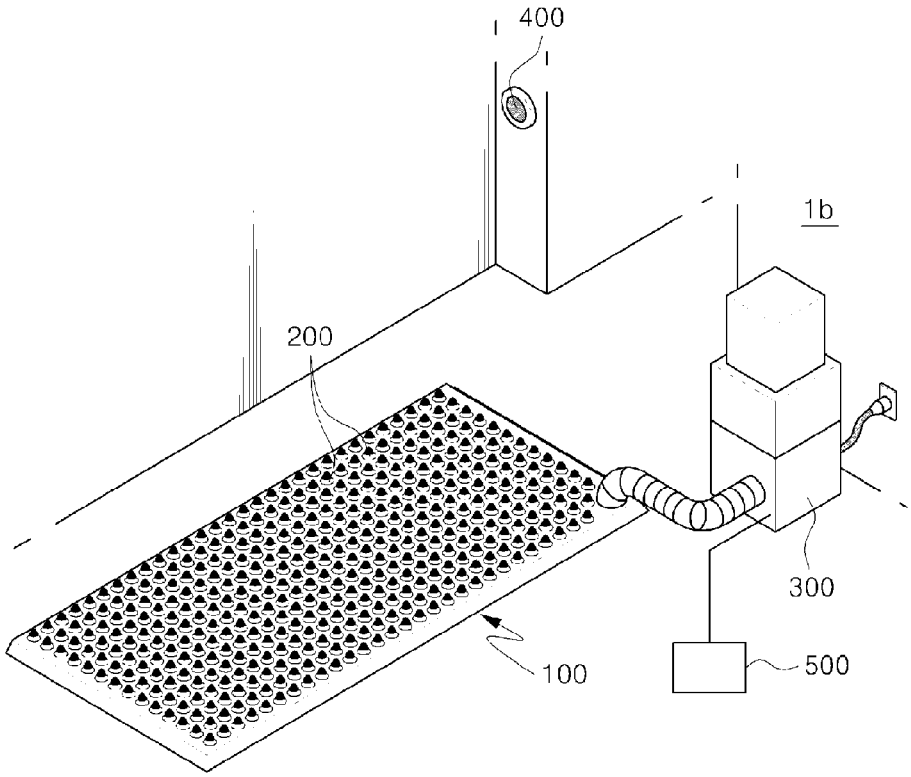
[Fig. 8]
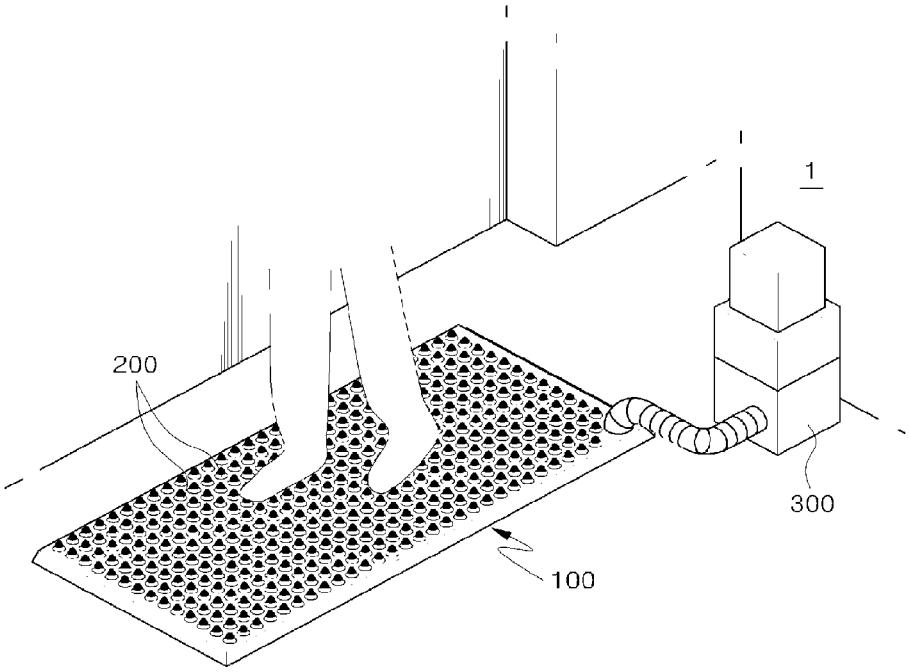

[Fig. 9]
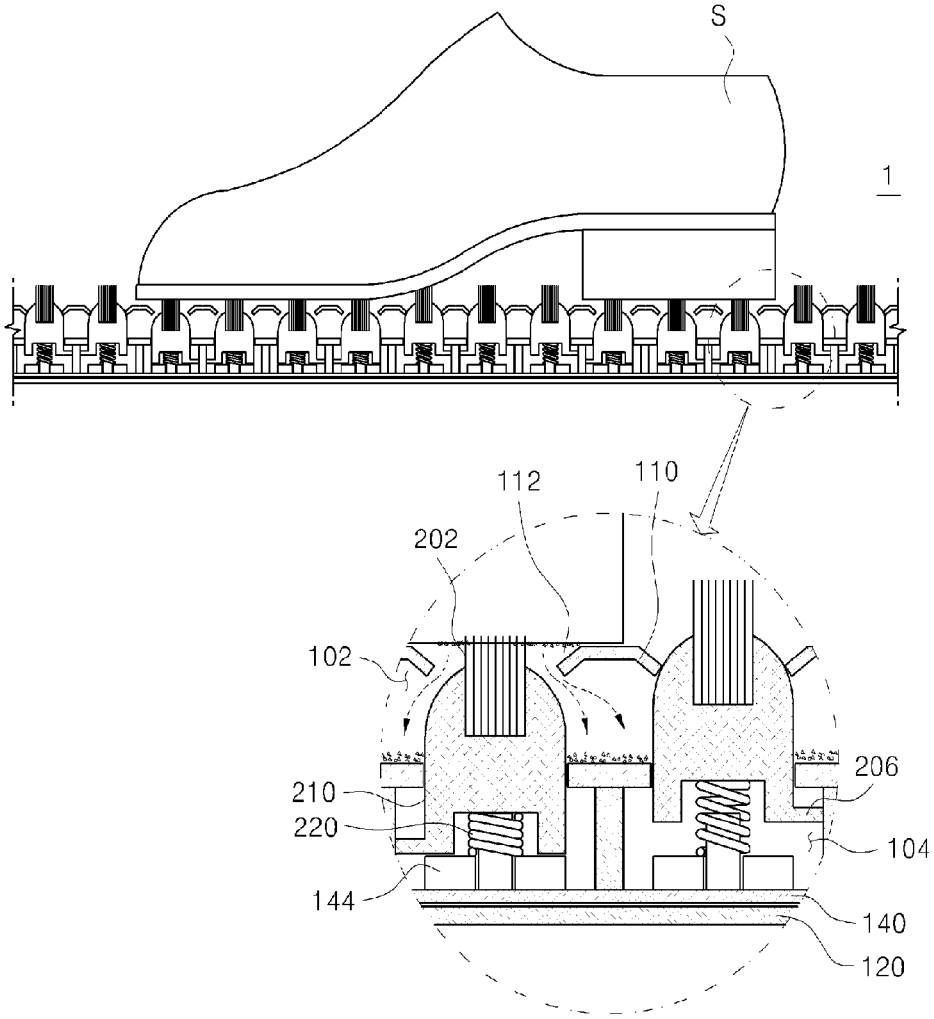
[Fig. 10]
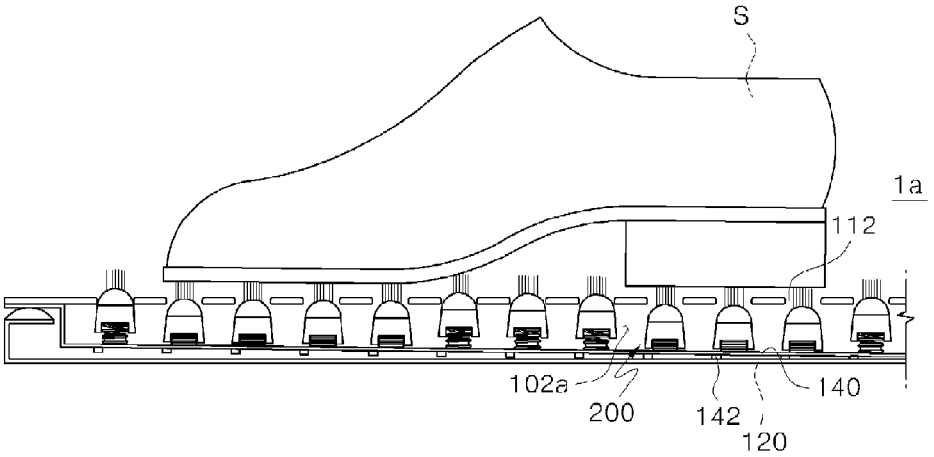

[Fig. 11]
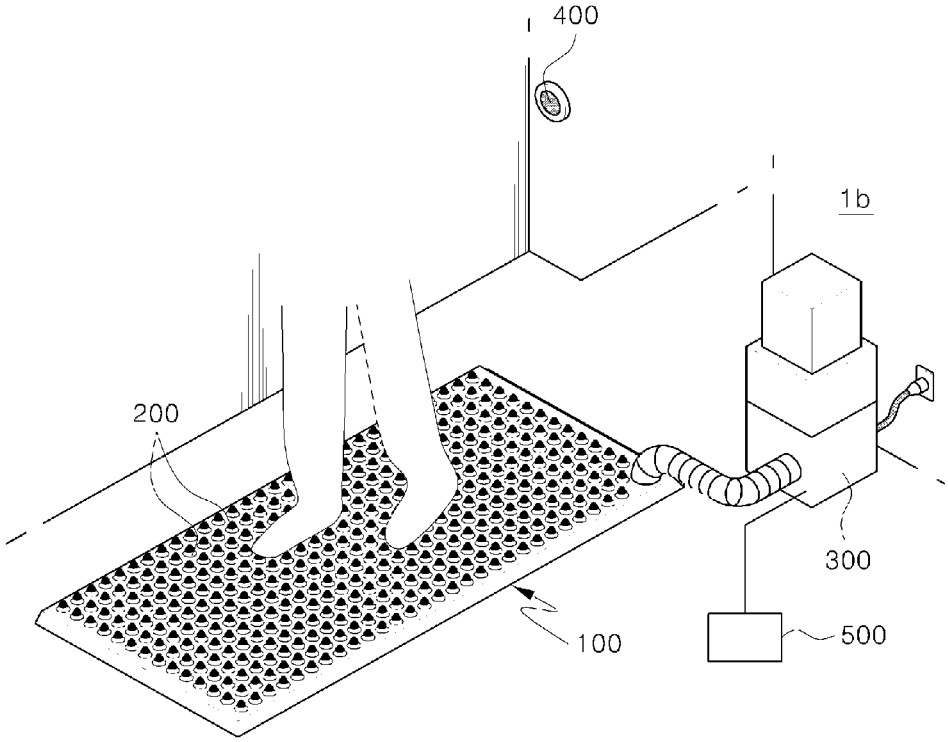

DUST SUCTION DEVICE

TECHNICAL FIELD

The present invention relates to a mat for sucking dust and, more specifically, to a dust suction device for sucking dust and impurities covered on the bottoms of the shoes of a visitor who enters through an exit leading to the outside.

BACKGROUND ART

In general, a mat is used for adsorbing moisture, dust and the like at an exit through which visitors frequently pass to an indoor or outdoor place so as to maintain the clean state of the indoor place. In particular, the mat is used for various purposes at the exits of not only normal houses but also facilities, which prohibit the penetration of pollution sources from the outside, such as factories, laboratories, hospitals and the like, thereby removing dust and impurities covered on the shoes of the visitors.

In general, normally used mats are mostly made from fabrics in order to adsorb moisture or dust. However, the prior art mat made from fabrics has problems of mold growth after the dust and impurities, which are introduced from the outside, are adsorbed in the mat or horribly bad smell generated from the mold. In addition, a user has to periodically sterilize or wash the mat in order to maintain the mat in a clean state. Otherwise, the mat can be a breeding ground for bacteria.

In addition, the prior art mat has various problems, due to the simple weave construction thereof, that the mat has low absorbability with respect to moisture or dust, cleanliness after the washing thereof cannot be maintained long, and the shape of the mat is likely to be partially deformed for a long term use, thereby decreasing the product life cycle thereof.

In order to solve the above problems, various dust suction devices have been disclosed in order to remove or suck the dust covered on the shoes so far.

According to a prior art dust suction device 10, if a visitor steps on a mat 20, which is formed in the shape of a scaffolding, spring members 30 of the areas, where the feet of the visitor are positioned, are lowered and suction holes 22 are opened such that the dust and impurities covered on the bottom surfaces of the shoes of the visitor are introduced through the suction holes, as shown in accompanying FIG. 1 and FIG. 2

Further, the dust introduced through the suction holes 22 is sucked into a suction machine 40 by the suction force generated by the operation of the suction machine 40 such that the dust and impurities covered on the bottom surfaces of the shoes can be removed.

However, the prior art dust suction device 10 used as above have problems that the dust and impurities introduced through the suction holes 22 are stacked on the places, where spring members 30 are mounted, in a predetermined thickness, thereby disturbing the downward movement of the spring members 30 and the introduction of the dust and impurities from the bottom of the shoes through the suction holes 22. Therefore, it is necessary to provide measures to solve these problems.

DISCLOSURE

Technical Problem

Embodiments of the present invention are to individually separate a space, into which dust is sucked, and a space, in which elastic members are placed, from each other into independent spaces so as to prevent the malfunction of resiliently operating members, which is likely to be caused by dust.

The embodiments of the present invention are to selectively suck dust according to the existence of a visitor who enters through an exit.

Technical Solution

According to one aspect of the present invention, a dust suction device comprises: a housing having a plurality of inlets formed so as to introduce impurities and an inner region of which is independently divided; and resiliently operating members provided inside the inlets so as to open or close the inlets by pressure applied from the outside.

The housing includes: a top plate provided with the inlets; a bottom plate provided at the lower portion of the housing; a separation plate positioned to be spaced from the bottom plate at a predetermined distance h1 in the upward direction; and partition walls for defining the inside of the housing in the traversal direction and positioned between the top plate and the separation plate.

The bottom plate includes: folded parts, which are folded in the upward direction towards the top plate at both ends; and damping parts provided on the top surfaces of the folded parts.

The partition wall includes: support members provided to the bottom surface thereof and extending towards the separation plate; and insertion holes to be inserted by the resiliently operating members.

The housing includes: first space parts formed between the partition wall and the top plate such that dust introduced through the inlets is collected therein; and second space parts formed at the lower portions of the first space parts so as to be provided between the separation plate and the partition wall.

The top plate includes an outlet for discharging the dust collected in the first space parts.

The top plate further includes auxiliary holes formed to be opened in the peripheries of the inlets and sucking the air in the periphery of the top plate or dust and impurities included in the air.

The resiliently operating members includes: heads inserted into the inlets; and elastic members provided at the lower sides of the heads and elastically supporting the heads.

The separation plate further includes stoppers provided at the lower sides of the heads.

The dust suction device further includes a suction machine for sucking the dust, which is introduced through the inlets, to the outside.

According to another embodiment of the present invention, a dust suction device comprises: a housing having a plurality of inlets formed so as to introduce impurities and an inner region of which is independently divided; a separation plate for defining the inside of the housing in the traversal direction and having stoppers formed on the bottom surface thereof; and resiliently operating members provided inside the inlets so as to open or close the inlets by pressure applied from the outside.

According to a further embodiment of the present invention, a dust suction device comprises: a housing having a plurality of inlets formed so as to introduce impurities and an inner region of which is independently divided and connected to a suction machine for sucking dust, which is introduced through the inlets; resiliently operating members provided inside the inlets so as to open or close the inlets by pressure applied from the outside; and a controller for receiving a signal output from a sensor, which is provided at one side of an exit, so as to control power applied to the suction machine.

The controller applies power to the suction machine for t seconds according to the signal output from the sensor and then converts the suction machine into an off-state.

Advantageous Effects

Dust suction devices according to the embodiments of the present invention can be stably used even for a long term while preventing the malfunction of elastic members, which is caused by impurities, by stacking dust and impurities in separately divided areas, and also suck the impurities covered on shoes and the dust floating in the periphery of a dust suction device.

Dust suction devices according to the embodiments of the present invention can be provided in various places such as houses, offices, hospitals, laboratories and the like so as to stably remove impurities from the shoes of visitors.

DESCRIPTION OF DRAWINGS

FIG. 1 is a perspective view illustrating a prior art dust suction device.

FIG. 2 is a cross-sectional view illustrating a using state of the prior art dust suction device.

FIG. 3 is a perspective view illustrating a dust suction device according to one embodiment of the present invention.

FIG. 4 is a cross-sectional view illustrating the dust suction device according to the embodiment of the present invention.

FIG. 5 is a plane view illustrating a top plate according to the embodiment of the present invention.

FIG. 6 is a cross-sectional view illustrating a dust suction device according to another embodiment of the present invention.

FIG. 7 is a cross-sectional view illustrating a dust suction device according to a further embodiment of the present invention.

FIG. 8 is view showing a using state of a dust suction device according to the one embodiment of the present invention.

FIG. 9 is a cross-sectional view showing a using state of a dust suction device according to the one embodiment of the present invention.

FIG. 10 is view showing a using state of a dust suction device according to according to another embodiment of the present invention, and FIG. 11 is view showing a using state of a dust suction device according to according to the further embodiment of the present invention.

MODE FOR INVENTION

Hereinafter, a dust suction device according to an embodiment of the present invention with respect to the configuration thereof with reference to the accompanying drawings. FIG. 3 is a perspective view illustrating a dust suction device according to an embodiment of the present invention, and FIG. 4 is a cross-sectional view illustrating the dust suction device according to the embodiment of the present invention.

Referring to accompanying FIG. 3 and FIG. 4, a dust suction device 1 includes a housing 100 formed in a rectangular plate shape, and resiliently operating members 200 provided to the housing 100 and operating by pressure applied from the outside.

Even though the housing 100 is illustrated in the rectangular shape in this embodiment, the housing 100 is not necessarily limited to the rectangular shape and can be modified into any other shape.

The housing 100 includes a top plate 110, a bottom plate 120, a partition wall 130 and a separation plate 140 and may be made from a material having no concern for corrosion and oxidation.

The top plate 110 is formed of plastics or epoxy and may be formed in the thickness of 3 mm, wherein the thickness is not necessarily limited thereto. In addition, the top plate 110 may have a top surface on which figures, logos and patterns can be printed as desired.

The top plate 110 has a plurality of inlets 112 formed to be spaced at a predetermined interval such that dust and impurities covered on the bottom of shoes can be introduced through the inlets 112. According to this embodiment, the diameter of the inlets 112 is not particularly limited and can be changed according to the whole size of the housing 100.

The top plate 110 can be formed by mixing raw materials with minerals such as ceramics in the shape of powder so as to provide sterilizing and antibacterial actions with respect to the dust or impurities such that the antibacterial actions with respect to the germs and mold included in the dust and impurities can be carried out.

The top plate 110 has the plurality of inlets 112, which are formed at a same interval in the top surface thereof and opened in a predetermined diameter so as to introduce the dust and impurities. Even though the diameter of the inlets 112 is not particularly limited in this embodiment, it is preferable that the inlets opened in a dust suction devices used in a facility such as a factory or a hospital have a relatively larger diameter rather than that of the inlets opened in a dust suction device used at home. Because the factory and hospital have relatively more visitors rather than a family house and the impurities covered on the bottom surfaces of the shoes of the visitors are proportional to the numbers of such visitors.

The bottom plate 120 is provided at the lower side of the dust suction device 1 and formed in a size corresponding to that of the top plate 110, and includes folded parts 122, which are folded in the upward direction towards the top plate 110 at both ends thereof, and damping parts 124, which are provided to the top surfaces of the folded parts.

The folded parts 122 are formed in a shape, in which the both ends of the bottom plate 120 are extended towards the top plate in the vertically upward direction and then folded inwards at 90°. The reasons of forming the bottom plate 120 with the folded parts 122 are to disperse a load applied to the top plate 110 throughout the housing 100 through the damping parts 124, which are described hereinafter, and simultaneously promote supporting through the damping parts 124.

The damping parts 124 are provided to the top surfaces of the folded parts 122, wherein any one of rubber, silicon or leaf springs can be selectively used as the damping parts 124 and it is also possible to provide any other feature which has a damping function.

The damping parts 124 are formed in a shape, in which the damping parts 124 are curved towards the top plate 110, and provided to be spaced from the top plate 110 at a predetermined distance. If the damping parts 124 are formed of rubber, as an example, the damping parts 124 can be deformed to be elastically compressed by the load applied to the top plate 110 so as to support the load applied to the top plate 110.

The separation plate 140 is positioned to be spaced from the bottom plate 120 at a predetermined distance h1 in the upward direction such that the separation plate 140 can minimize an impact applied to the bottom plate 120 through the distance h1 while partially drooping downwards when a load is applied to the damping parts 124. The spacing distance h1, according to the present embodiment, is 1 mm or less.

The separation plate 140 has folded parts 142, which are folded in the vertically upward direction towards the top plate 110 at both ends thereof, and the folded parts 142 are formed to be extended in a state, in which the folded parts 142 are in close contact with the bottom surface of the top plate 110 so as to support pressure applied to the top plate 110 therethrough.

The partition wall 130 is positioned between the top plate 110 and the bottom plate 120 and defines the inside of the housing 100 in the traversal direction. The partition wall 130 is provided so as to independently divide the inner region of the housing 100. The reason of dividing the inside of the housing 100 through the partition wall 130 as above is to separate the dust and impurities, which are introduced through the inlets 112, into separate spaces from those for the resiliently operating members 200 such that the dust and impurities can be removed from the inside of the housing 100 by using a suction machine 300, which will be described hereinafter.

The partition wall 130 has insertion holes 134 formed to be opened at positions corresponding to those of the inlets 112 so as to be inserted by the resiliently operating members 200. The insertion holes 134 are inserted by the resiliently operating members 200 and formed in a diameter corresponding to the diameter of the resiliently operating members 200.

The partition wall 130 includes support members 132, which are provided at the lower side thereof and formed to be extended towards the separation plate 140, and the support members 132 prevent the downward drooping phenomenon of the partition wall 130.

The partition wall 130 defines the inside of the housing 100 respectively into first space parts 102 and second space parts 104. The first space parts 102 are to stack the dust and impurities introduced through the inlets 112 and defined as independent separate spaces from the second space parts 104. That is, the dust and impurities are only introduced into the first space parts 102 but blocked from being introduced into the second space parts 104.

The first space parts 102 are formed between the partition wall 130 and the top plate 110, and the dust and impurities can be introduced into the areas of the first space parts 102 through the inlets 112 only when the inlets 112 are opened by the resiliently operating members 200.

The second space parts 104 are formed at the lower side of the first space parts 102 and serve as the spaces for securing the stable operations of the resiliently operating members 200 without the introduction of the dust and impurities which are introduced through the inlets 112.

The resiliently operating members 200 includes heads 210 inserted into the inlets 112 and elastic members 220 provided at the lower sides of the heads 210 so as to elastically support the heads 210.

The heads 210 are respectively formed in a cylindrical shape, in which the upper portions are formed in the shape of a hemisphere, and have a plurality of brushes 202 provided on the upper portions such that the brushes 202 can serve to separate dust and impurities remaining on the bottom surfaces of shoes to the top plate 110 while coming into contact with the bottom surfaces.

Each of the elastic members 220 is provided with a coil spring, which is wound in a predetermined length, in the center of the lower side of each of the heads 210. However, it should be noted that a spring in any other shape and structure may be provided too. The elastic members 220 elastically support the lower sides of the heads 210 all the time and, therefore, the heads 210 can maintain the inlets 112 in the closed state all the time before any additional load is applied thereto. For reference, the elastic members 220 are inserted into the elastic member support members 204, which are provided to the separation plate 140.

The separation plate 140 as described above further includes stoppers 144, which are provided to the lower sides of the heads 210, and the stoppers are provided to be spaced from the heads 210 at a predetermined distance.

As for the stoppers 144, it is possible to provide, in advance, stoppers which have different projection lengths from each other according to the lowering lengths of the heads 210, and the stoppers 144 can be varied according to the specifications of dust suction devices in the procedure of manufacturing.

The suction machine 300 is connected to an outlet 111 through a tube such that the dust and impurities stacked in the first space parts 102 can be sucked by the suction machine 300 after the use of the dust suction device 1 for a predetermined period, or by intermittently driving the suction machine 300.

Referring to accompanying FIG. 5, the top plate 110 has a plurality of auxiliary holes 114 formed in the peripheries of the inlets 112, and the auxiliary holes 114 are formed to suck the dust and impurities included in the air in the peripheries of shoes in addition to the inlets 112. The auxiliary holes 114 are maintained in the opened state all the time and introduce the dust and impurities included in the air in the periphery of the top plate 110 regardless of the opening or closing state of the resiliently operating members 200.

The top plate 110 includes the outlet 111 for discharging the dust stacked in the first space parts 102, which will be described hereinafter, and the outlet 111 is coupled to the tube provided to the suction machine 300. For reference, as for the suction machine 300, a device like a normal vacuum cleaner which can suck dust or a vacuum device for generating vacuum pressure is used.

Now, the configuration of a dust suction device according to another embodiment of the present invention will be described with reference to accompanying drawings. Differently from the above mentioned dust suction device, a dust suction device according to another embodiment of the present invention does not include the partition wall and has a housing of which thickness is relatively decreased, and the use of this dust suction device is limited to family use.

Referring to accompanying FIG. 6, a dust suction device 1*a* includes a housing 100 having plurality of inlets 112 formed so as to introduce impurities and an inner region of which is independently divided, a separation plate 140 for defining the inside of the housing 100 in the traversal direction and having stoppers 142 formed on the bottom surface thereof, resiliently operating members 200 provided inside the inlets 112 so as to open or close the inlets 112 by pressure applied from the outside, and a suction machine 300 (see FIG. 3) for sucking the dust, which has been introduced into the housing 100, to the outside.

The housing 100 includes a top plate 110, a bottom plate 120 and a separation plate 140, wherein the configuration of the top plate 110 and the bottom plate 120 are the same as that of FIG. 3 and thus the explanation thereof will be omitted.

The separation plate 140 is positioned to be spaced from the bottom plate 120 at a predetermined distance h2 in the upward direction and has a plurality of stoppers 142 formed on the bottom surface thereof. The spacing distance h2 may be 1 mm to 3 mm, wherein the sum of the distance h2 and the height of the resiliently operating members 200, which will be described hereinafter, is 2 cm or less such that stable dust suction can be facilitated with minimum thickness.

When the resiliently operating members 200 move downwards by a load applied to the top plate 110, the separation plate 140 can partially disperse and support the load together with the damping parts 124, which will be described hereinafter, and simultaneously prevent the excessive movement of the resiliently operating members 200 with the stoppers 142, wherein the vertical movement distance of the heads 210, which will be described hereinafter, can be increased by the distance h2 and more impurities can be introduced into third chambers 102*a*.

In the dust suction device 1*a* according to the present embodiment, differently from the dust suction device 1 mentioned as above, the dust and impurities introduced into the third chambers 102*a* defined in the housing 100 can be stacked on the elastic members 220 provided to the resiliently operating members 200. However, the dust suction device 1*a* is used at home and thus the malfunction due to the stacking of the dust and impurities can be minimized.

The resiliently operating members 200 include the heads 210 inserted into the inlets 112 and the elastic members 220 provided at the lower sides of the heads 210 so as to elastically support the heads 210. The heads 210 have upper portions formed in a hemispherical shape and a plurality of brushes provided to the upper portions. Reference sign 122, which is not explained, indicates folded parts provided to the bottom plate 120.

Now, the configuration of a dust suction device according to a further embodiment of the present invention will be described with reference to accompanying drawings. A dust suction device according to this embodiment is characterized in that the existence of a visitor who passes through an exit provided to a house or an office is sensed and the suction machine is selectively driven according to the sensing result. A dust suction device according to this embodiment is the same as the dust suction device illustrated in FIG. 3 in the main constituent elements thereof and thus the main constituent elements of a dust suction device according to this embodiment will be described with reference to FIG. 3.

Referring to accompanying FIG. 3 and FIG. 7, a dust suction device 1*b* includes the housing 100 having the plurality of inlets 112 formed so as to introduce impurities and the inner region of which is independently divided, the separation plate 140 for defining the inside of the housing 100 in the traversal direction and having the stoppers 142 formed on the bottom surface thereof, the resiliently operating members 200 provided inside the inlets 112 so as to open or close the inlets 112 by pressure applied from the outside, the suction machine 300 for sucking the dust, which is introduced into the housing 100, to the outside, a sensor 400 provided at one side of an exit, and a controller 500 for receiving a signal output from the sensor 400 so as to control power which is applied to the suction machine 300.

The controller 500 can apply power to the suction machine for t seconds according to the signal output from the sensor 400 and then convert the suction machine into an off-state.

The controller 500 includes an additional interrupter (not shown) for controlling the power applied to the suction machine 300 and an additional communications module (not shown) for receiving the signal transmitted from the sensor 400.

As for the sensor 400, any one of a proximity sensor, an ultrasonic sensor and a door open sensor for sensing the opening state of a door can be selectively used and any other sensors which are not mentioned in the present embodiment can also be used.

Now, the using states of the dust suction device according to this embodiment of the present invention structured as above will be described with reference to accompanying drawings. For reference, the dust suction device according to the present embodiment will be described, limiting the suction device is mainly used in a large-scaled building such as an office, a hospital, a factory and the like.

Referring to accompanying FIG. 4 and FIG. 8 to FIG. 9, the dust suction device 1 is provided to an exit (not shown) through which visitors pass frequently. A visitor stands on the top plate 110 in order to remove the impurities from his shoes S or walks slowly on the top plate 110.

A load applied to the housing 100 in a state, in which the visitor stands on a corner portion of the top plate 110, is transmitted to the damping parts 124 through the folded parts 142 of the separation plate 140, which is in close contact with the top plate 110. Thus, the damping parts 124 are deformed to be elastically compressed so as to support and disperse parts of the pressure applied by the visitor. At the same time, the separation plate 140 comes in contact with the top surface of the bottom plate 120 while moving downwards by the predetermined distance h1, thereby supporting and dispersing the remaining of the pressure applied by the visitor.

When the shoes S of the visitor first come into contact with the brushes 202, the dust and impurities remaining on the bottom surfaces of the shoes S fall down to the top plate 110. Further, the heads 210 elastically compress the elastic members 220 by the weight of the visitor and move downwards to the lower side of the inlets 112.

In addition, as the plurality of heads 210 corresponding to the areas of the shoes S move downwards, the inlets 112 in the closed state are maintained in a temporarily opened state and thus the dust and impurities on the shoes S are introduced into the first space parts 102 through the inlets 112. When the pressure, which presses the top surfaces of the heads 210, are released, the heads 210 move towards the inlets 112 by the elastically restoring force of the elastic members 220, thereby closing the inlets 112.

After the heads 210 have moved downwards, the heads 210 are maintained in the moved state without any more downwards movement by means of the stoppers 144. If the visitor walks along the top plate 110, the plurality of heads 210 corresponding to the areas of the shoes S of the visitor move downwards by the pressure and then restored to the initial positions thereof with a time difference, and the plurality of inlets are temporarily opened and then closed, in response to the movement of the plurality of heads 210.

A load applied to the housing 100 in a state, in which the visitor stands on the opposite corner portion through the top plate 110, is transmitted to the damping parts 124 through the folded parts 142 of the separation plate 140, which is in close contact with the top plate 110, and the damping parts 124 are deformed to be elastically compressed so as to support and disperse parts of the pressure applied by the visitor. At the same time, the separation plate 140 comes in contact with the top surface of the bottom plate 120 while moving downwards by the predetermined distance h1, thereby supporting and dispersing the remaining of the pressure applied by the visitor.

Through the auxiliary holes 114 (see FIG. 5) in addition to the inlets 112, the dust and impurities in the peripheries of the top plate 110 can be continuously introduced into the first space parts 102 from before a state, in which the inlets 112 are opened. Therefore, the dust in the peripheries of the shoes S and the dust remaining on the top plate 110 can be introduced through these auxiliary holes 114 regardless of the operation of the resiliently operating members 300.

The dust introduced into the first space parts 102 do not move to the second space parts 104 but are maintained in a state, in which the dust are stacked in a predetermined thickness in the first space parts 102, such that the dust the elastic members 220 provided to the resiliently operating members 300 are free from the problems of the malfunction caused by the dust introduced into the first space parts 102 and the stacking of the impurities on the elastic members 220.

In the process of introducing the dust and impurities remaining on the shoes through the inlets 112 as above, a large amount of anions and far infrared rays are generated outside through the top plate 110 and the brushes 202 so as to sterilize bacterial viruses remaining on the areas in the proximity of the top plate 110 and simultaneously remove the smell due to the dust and impurities stacked in the first space parts 102.

After the dust suction device 1 has been used by a great number of visitors, a large amount of dust stacked in the first space parts 102 are moved to the suction machine 300 through the outlet 111 such that the dust and impurities from the visitors who pass the exit can be easily removed.

In the resiliently operating members 200 according to the present embodiment, the plurality of heads are maintained in a mutually coupled state through connection members 206. Therefore, if any one of the coupled heads is moved downwards, the other heads are also moved downwards and thus can open the inlets 112. Therefore, the dust and impurities in the peripheries of the bottom surfaces of the shoes S are simultaneously removed while some of the heads, which are pressed downwards by the shoes S, and the other heads, which are coupled to the some of the heads through the connection members 206, are moved downwards together.

Now, the using states of the dust suction device according to another embodiment of the present invention will be explained with reference to accompanying drawings. In the explanation, the dust suction device according to the present embodiment is limited to family use and the internal structure thereof is limited to be the same as that illustrated in FIG. 3.

Referring to accompanying FIG. 10, the dust suction device 1*a* according to the present invention is similar to the dust suction device 1 as described above in the whole operational states, wherein the dust and impurities introduced through the inlets 112 are stacked in the third chambers 102*a* and the damping parts 200 supports and disperses a load while being deformed to be elastically compressed by the pressure applied by a visitor.

The separation plate 140 can be moved downwards towards the bottom plate 120, but are supported on the top surface of the bottom plate 120 such that partial damping is carried out.

After the dust suction device 1*a* has been used by a great number of visitors, a large amount of dust stacked in the third chambers 102*a* are moved to the suction machine 300 through the outlet 111 such that the dust and impurities from the visitors who pass the exit can be easily removed.

Now, the using states of a dust suction device according to a further embodiment of the present invention will be explained with reference to accompanying drawings.

Referring to accompanying FIG. 11, when a visitor opens a door and enters into a room, the dust suction device 1*b* according to the present embodiment senses the entering state of the visitor by the sensor 400 and the sensed signal is transmitted to the controller 500.

The controller 500 determines that a visitor entered through the door according to the received signal and transmits a control signal so as to operate the suction machine 300 for t seconds, thereby operating the suction machine 300.

As the visitor walks along the top plate 110, the bottom surfaces of the shoes of the visitor first come into contact with the brushes 202, and the dust and impurities remaining on the bottom surfaces of the shoes fall down to the top plate 110. In addition, the heads 210 are moved downwards to the lower sides of the inlets 112 while elastically compressing the elastic members 220 by the weight of the visitor, and the dust and impurities are moved to the first space parts 102 through the inlets 112. Further, the dust and impurities in the peripheries of the shoes are also introduced to the first space parts 102 through the auxiliary holes 114.

The control part 500 applies power to the suction machine 300 such that the suction machine 300 can operate for an average time for visitors to pass through the top plate 110. After that, the control part 500 controls the power, which is applied to the suction machine 300, to be turned off.

Therefore, the suction machine 300 selectively operates only when a visitor passes through the exit, and thus the dust and impurities can be removed through the dust suction device 1*b*.

As described above, while the present invention has been particularly shown and described with reference to the exemplary embodiments thereof, it will be understood by those of ordinary skill in the art that various changes, modifications and equivalents may be made by the addition, changes, deletion or supplements and the like of constituent elements within the scope of the present invention defined by the following claims and also belong to the technical scope of the present invention.

EXPLANATION OF ESSENTIAL REFERENCE NUMERALS IN DRAWINGS

100: housing
102, 104: first and second chambers
112: inlets
120: bottom plate
130: partition wall
140: separation plate
200: resiliently operating members
210: heads
220: elastic members

The invention claimed is:

1. A dust suction device comprising:

a housing having a plurality of inlets formed so as to introduce impurities and an inner region of which is independently divided; and resiliently operating members provided inside the inlets so as to open or close the inlets by pressure applied from the outside, wherein the housing comprises:

a top plate provided with the inlets;

a bottom plate provided at the lower portion of the housing;

a separation plate positioned to be spaced from the bottom plate at a predetermined distance (h1) in the upward direction; and partition walls, for defining the inside of the housing in a traversal direction and positioned between the top plate and the separation plate, and wherein the bottom plate comprises:

folded parts, which are folded in the upward direction towards the top plate at both ends; and damping parts provided on the top surfaces of the folded parts.

2. The dust suction device according to claim 1, wherein the housing comprises:

first space parts formed between the partition wall and the top plate such that dust introduced through the inlets is collected therein; and second space parts formed at the lower portions of the first space parts so as to be provided between the separation plate and the partition wall.

3. The dust suction device according to claim 2, wherein the top plate comprises an outlet for discharging the dust collected in the first space parts.

4. The dust suction device according to claim 1, wherein the top plate comprises an outlet for discharging the dust collected in the first space parts.

5. The dust suction device according to claim 1, wherein the top plate further comprises auxiliary holes formed to be opened in the peripheries of the inlets and sucking the air in the periphery of the top plate or dust and impurities included in the air.

6. The dust suction device according to claim 1, wherein the resiliently operating members comprises:

heads inserted into the inlets; and elastic members provided at the lower sides of the heads and elastically supporting the heads.

7. The dust suction device according to claim 6, wherein the separation plate further comprises stoppers provided at the lower sides of the heads.

8. The dust suction device according to claim 1, wherein the dust suction device further comprises, a suction machine for sucking the dust, which is introduced through the inlets, to the outside.

9. A dust suction device comprising:

a housing having a plurality of inlets formed so as to introduce impurities and an inner region of which is independently divided; and resiliently operating members provided inside the inlets so as to open or close the inlets by pressure applied from the outside, wherein the housing comprises:

a top plate provided with the inlets;

a bottom plate provided at the lower portion of the housing;

a separation plate positioned to be spaced from the bottom plate at a predetermined distance (h1) in the upward direction; and partition walls for defining the inside of the housing in a traversal direction and positioned between the top plate and the separation plate, and wherein the partition wall comprises:

support members provided to the bottom surface thereof and extending towards the separation plate; and insertion holes to be inserted by the resiliently operating members.

* * * * *